US006994661B1

(12) United States Patent
Dawson

(10) Patent No.: US 6,994,661 B1
(45) Date of Patent: Feb. 7, 2006

(54) TILTABLE EXERCISE BENCH

(76) Inventor: Fred Dawson, 1005 Standard St., Suite A, Reno, NV (US) 89506

( * ) Notice: Subject to any disclaimer, the term of this patent is extended or adjusted under 35 U.S.C. 154(b) by 86 days.

(21) Appl. No.: 10/286,519

(22) Filed: Nov. 1, 2002

(51) Int. Cl.
*A63B 22/16* (2006.01)

(52) U.S. Cl. ..... 482/146; 482/147; 482/34

(58) Field of Classification Search ..... 482/142, 482/148, 908; 5/663, 3, 507.1, 600; 297/135, 297/119; D24/183; 273/280; 108/144.11, 108/16; 473/496
See application file for complete search history.

(56) References Cited

U.S. PATENT DOCUMENTS

| | | | | | |
|---|---|---|---|---|---|
| 194,477 | A * | 8/1877 | Reily | 272/93 |
| 425,153 | A * | 4/1890 | Grider | 125/41 |
| 4,546,967 | A * | 10/1985 | Kecala | 272/93 |
| 4,746,114 | A * | 5/1988 | Grider | 272/123 |
| 5,082,259 | A * | 1/1992 | Gonzalez | 482/41 |
| D406,290 | S * | 3/1999 | McBride | D21/690 |
| 6,030,324 | A * | 2/2000 | McBride | 482/142 |
| 6,106,445 | A * | 8/2000 | Lay | 482/142 |
| 6,287,243 | B1 * | 9/2001 | Isom et al. | 482/142 |
| 6,468,191 | B1 * | 10/2002 | Cameron | 482/140 |
| 6,659,923 | B2 * | 12/2003 | Teuscher | 482/142 |

* cited by examiner

*Primary Examiner*—Gregory L. Huson
*Assistant Examiner*—L. Amerson
(74) *Attorney, Agent, or Firm*—Robert Samuel Smith

(57) ABSTRACT

A tiltable exercise bench featuring a pad hingeably mounted on a vertical post by a cantilevered hinge joint such that the bench can be tilted to a selected angle depending on the requirements of the user. An arcuate bar with notches on one edge has ends secured to the underside of the pad, extends downwards toward the base of the bench. The arcuate bar has notches formed along one elongated edge. A spring-loaded lever is arranged to engage a selected one of the notches whereby the bench is fixed at a selected angle of tilt. The lever can be operated from the left or right side of the bench. A series of tubular bars, affixed perpendicular to the underside of the bench support bar, provide selectable positions for telescoping onto a bar attached to the bench seat or a bar attached to a padded bar for performing situps or back extensions.

13 Claims, 4 Drawing Sheets

TILTABLE EXERCISE BENCH

FIELD OF THE INVENTION

This invention relates to exercise benches of the found in the exercise room for performing situps, bench presses and exercises with dumbbells and particularly to a bench that is tiltable.

BACKGROUND INFORMATION

An important item in many exercise rooms is a bench used in conjunction with other gear, particularly, dumbbells and barbells. One exercise performed with dumbbells and the bench are referred to as "flies" where the user lies back down on the bench and, holding a dumbbell in each hand, extends his arms out to his side or over his head. (like a bird flapping its wings).

Such benches are typically provided with a bar at one end of the bench that "hooks" the users legs and enables him to perform situps and back extensions.

In another version of a bench, the bench can be "fixed" at a selected tilt so that the user can perform presses with his body tilted at a selected angle.

These features permitting exercises at various inclination of the body are performed to stress the musculature in various ranges of motion so as to provide a full body workout.

The present state of the art tiltable bench comprises an upholstered pad intended to support the back of the user. The pad is supported by a hinge to a frame that permits tilting the pad like a seesaw. A second pad is also hinged to the frame that is tiltable and supported by a separate support mechanism. In order for the user to change the tilt of the bench, the user must pull spring loaded pins to disengage the pins from locating holes in the frame and hold the spring loaded pins out with one hand while moving the back rest and/or seat apparatus to a new position with the other hand. Some of these designs incorporate supporting braces which connect at one end to the pad and the other to a position of the bench to provide needed support for the pad. These support bars must be manually relocated for each new angle selected.

A problem with using the popit pin to engage the changing mechanism is that the nature of the design including a popit pin fitting into a hole is that the tolerance on the hole diameter must be very loose in order that the popit pin may move can move freely in and out of the engagement hole without being stuck or hard to pull. The looseness results in "play" or movement in the holding mechanism and makes the bench feel unstable to the user.

Another problem with the design of the prior art is a design limitation wherein the separately hinged seat is not always aligned with the backrest pad when the seat is oriented to near a 90 degree angle. When the angle between back rest and seat in the incline position is greater is greater than 95 degrees, the user has a tendency to slide down the seat while lifting heavy weight due to the center of gravity change while lifting from the shoulders and above and is forced to use his legs for stability that should be provided by the seat thus taking away focus and energy from the muscle group being exercised.

Another problem with the prior art is the inability of the bench to assume a complete range of angles a lifter might desire. These angles are commonly referred to as: incline, decline, flat and seated shoulder press positions."

Another problem with the prior art is the ability of the bench seat to be adjustable in height in relation to the floor so that users of different body sizes and the seat height that feel best for them individually. It is important that a lifter have his feet flat on the floor for maximum stability and a lifter with shorter legs should be able to move the seat down for to a lower position for that purpose while doing "incline presses."

Another problem with the prior art is inability to move Plug-in attachments higher and lower in relation to the floor. For instance, a leg extension-leg curl attachment of the prior art is set at a fixed height due to an inability of the support mechanism on the bench to go up or down relative to the floor. This causes a problem for a person with long legs and needing more floor clearance for leg extension.

Another problem with the prior art is lack of ability for the bench to be used as an abdominal exerciser with the ability to incrementally adjust the angle of gravitational resistance and thus increase or decrease the level of physical difficulty to perform the exercise.

For example, U.S. Pat. No. 6,030,324 to McBride discloses a bench having three legs (one leg on each end and a central leg that is positionable at three fixed angles of tilt.

This construction permits a selection of three angles of tilt, being a vertical back, a horizontal back and a slanted back.

U.S. Pat. Des. 425,153 discloses a tiltable bench comprising an upholstered back fixed to a seat that is supported by a hinge so that the seat and back are tiltable relative to a base. A plate with a semicircular array of holes is vertically mounted onto and extends downward from the bottom surface of the seat. The semicircular array of holes has a centerline of rotation that is coincident with the axis of rotation of the seat bench structure. A springloaded popit plunger, mounted on the frame of the bench, normally engages one of the holes of the array thereby securing the bench at the selected angle. In order to change the tilt of the bench, the user withdraws the popit pin and rotates the bench to a new tilt angle. Then he releases the popit pin to secure the bench at the selected tilt angle.

A problem with this design of the bench of the prior art is that the nature of the design causes the popit pin to be difficult to withdraw or even become stuck. In attempting to withdraw the pin, the user must reach under the bench and pull the pin in a horizontal direction. This is a direction of pull in which the typical user is inherently weak.

Another problem with the popit pin is that, unless the pin is exactly aligned with the hole, the pin will not engage the hole so that the user must "fish around" the hole until the pin drops into the hole.

U.S. Pat. No. 6,287,243 B1 to Isom discloses a back support hinged to a seat support. Second hinge couples the back support to a base. Inclination of the back and seat support is selectable by adjusting an extendable brace propped between the backrest and base. The design inherently limits the amount of weight that is supportable by the head end of the back support.

SUMMARY OF THE INVENTION

It is an object of this invention to provide an exercise bench which avoids the problems associated with the popit catch of the prior art.

In this regard, it is especially desired to provide a catch which the user can disengage by pushing rather than by pulling the catch and that the catch be accessable from either side of the bench. This direction of exertion permits him to include his bodyweight in disengaging the catch and even use his foot if he so desires.

Further in this regard, it is an object to adjust the "stiffness" of the catch.

Another desired characteristic of the catch is that the design be conducive to the catch being "self aligning" in that, if the catch is in the vicinity for engagement, then the catch will automatically align to secure the bench in its intended tilt angle.

Another object is that the support be inherently strong when the bench is horizontal since that is the position when exercises are performed which exert maximum force on the end of the bench.

It is another object that the détente for the catch be adjustable to permit compensating for manufacturing tolerances.

This invention is directed toward a bench comprising an upholstered pad that is supported at its center by a hinge so that the bench can be tiltable like a seesaw and then secured at a selected angle by a spring loaded "detente". The detente is mounted on the stationary frame of the bench and engages one of a row of "catches" (or notches) cut into a curved edge of an elongated flat rigid bar having a length greater than its width and is width greater than its thickness. The edges of the bar defining the width of the bar have an arcuate shape. The arcuate shape therefore defines two concentric arcs. The détente is released from the catch by pushing on the détente.

In one embodiment, the row of "catches" is cut into the edge of the innermost arc. In another embodiment, the row of "teeth is cut into the edge of the outermost arc.

The location of the seat to the back support is selectable so that the distance of seat from the floor is selectable regardless of the selected angle of tilt of the bench.

DESCRIPTION OF A PREFERRED MODE

Figure 1:
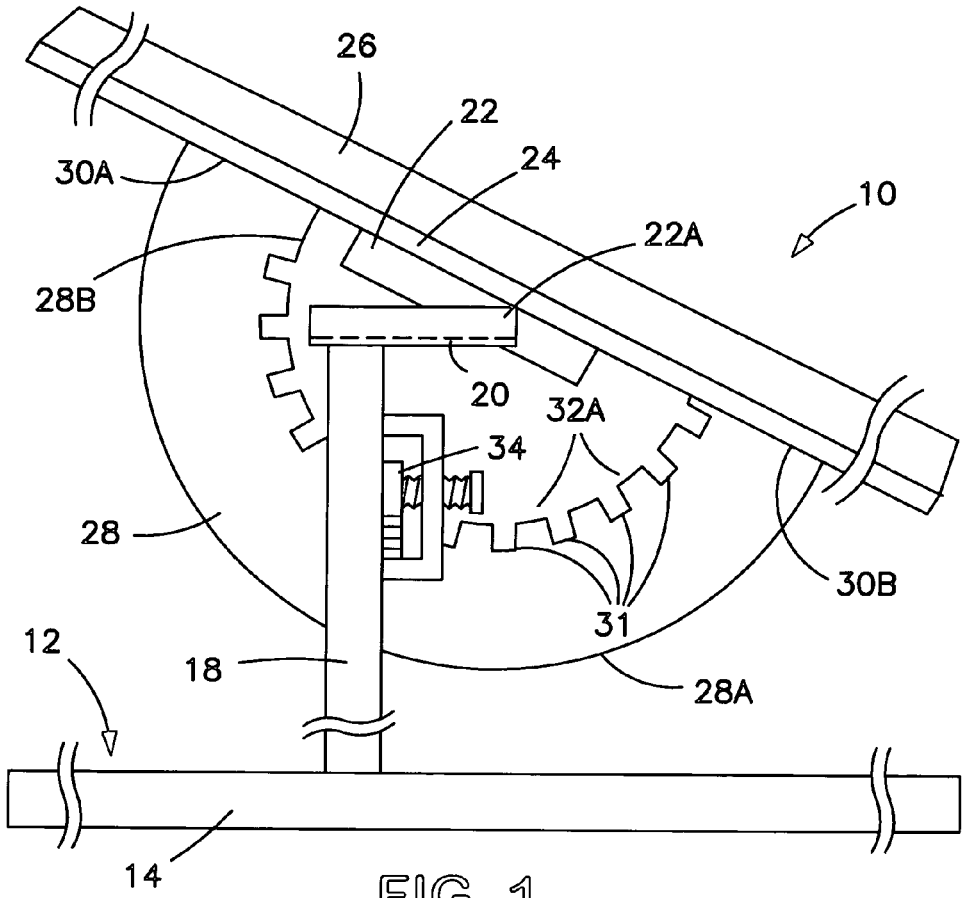
FIG. 1 is an elevational assembly view of the invention.

Turning now to a discussion of the drawings, FIG. 1 is a side view showing the exercise bench 10 of this invention.

A base being a "H" frame 12 is shown to better advantage by the top view of FIG. 2 as being a pair of horizontal beams 14 connected by connecting beam 16.

Figure 2A:
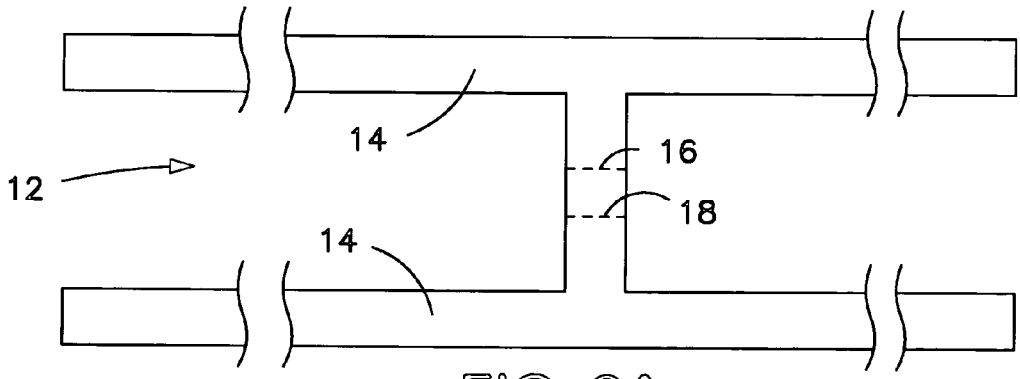
FIG. 2A is a top view of the base "H" frame and FIG. 2B is a view of the channel support.
Figure 2B:
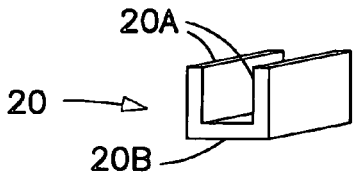

A vertical support post 18 shown in phantom in FIG. 2A has a lower end secured to and extending from the connecting beam 16. The upper end of the support post 18 is joined to one end of a horizontal channel 20. The upper end of the support post 18 is jpoined by a hinging member to a bench member.

The bench member comrises a panel 24 having a bottom surface facing the H frame 12 and an opposie surface interfacing flush against pad 26. In use, the user lies on the pad 26.

The hinging member comprises one section being a channel 20 (shown in FIG. 2B) and another section being a bar 22.

The channel 20 comprises two parallel side panels 20A joined by a hinging panel 20B. The joining panel of channel 20 is mounted on top of support post 18 and the other hinging section, being bar 22, is secured flush against the bottom surface of the panel 24.

The bar 22 is hingeably secured to the channel 20 by a hinging pin 22A such that the bar 22 nests between the two parallel sides on the joining side of the channel when the bench member is horizontal.

This structure permits tilting the pad 26 from a horizontal orientation to a vertical orientation.

In order to control tilt of the bench member 24, 26, there is shown a flat plate 28 having a broadest surface bounded by a major arcuate edge 28A concentric with and larger than a minor arcuate edge 28B and a pair of end edges 30 A,B between ends of the major and minor arcuate edges 28A,B. The end edges 28A,B are secured to the bottom surface of the panel 24 such that the plate 28 extends toward the H frame 12 away from the bench member.

Figure 3:
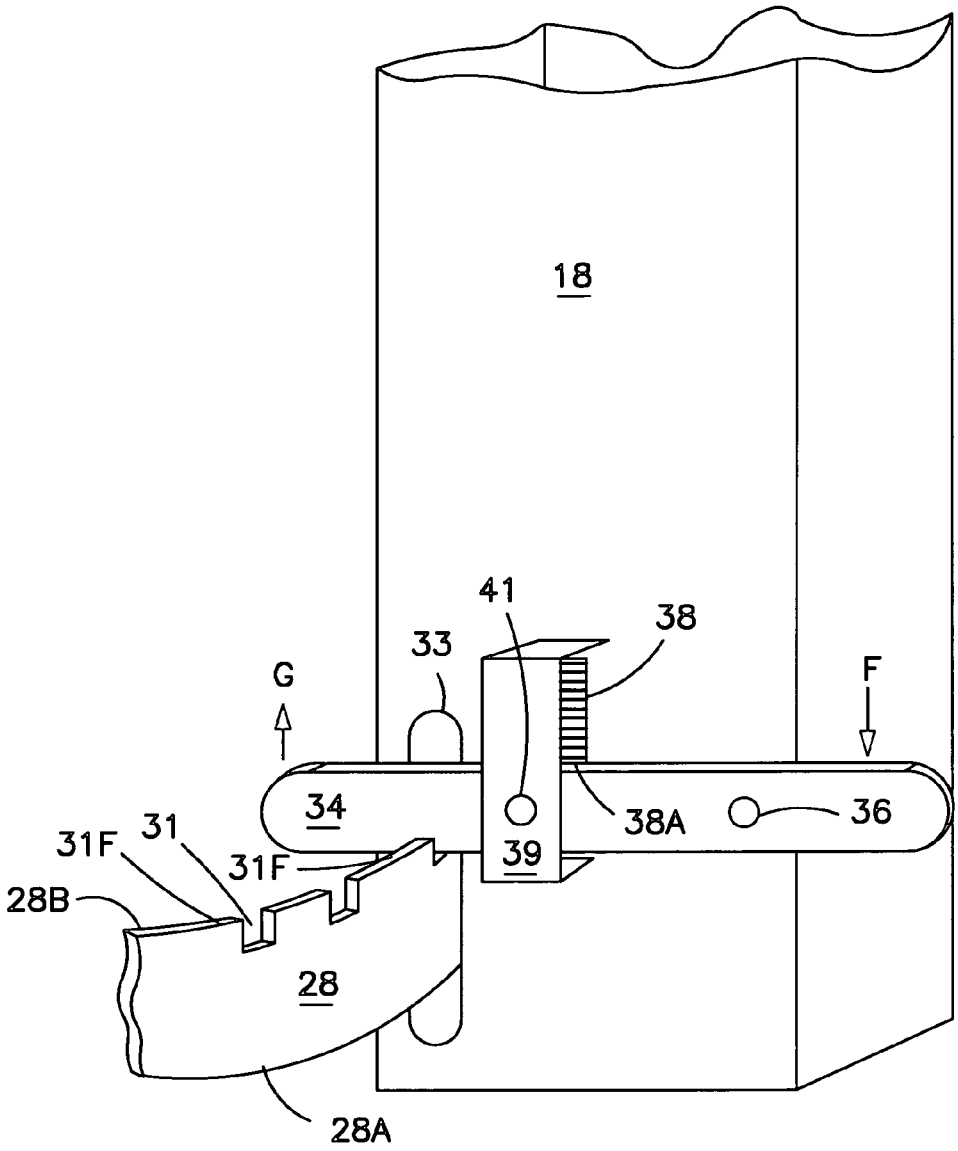
FIG. 3 is a view of details of the detente.

As shown to best advantage in FIG. 3, the plate 28 has a row of square notches 31 cut in the minor arc, arcuate edge 28. The notches 31 function as "catches" for a lever 34 that is pivotally mounted on the side of support beam 18. The lever 34 pivots about pin 36 mounted on the side of support post 18 and is biased by spring 38 to engage a selected one of the notches 31. The spring is retained in a keeper 39 supported on the side of the support post 18. The spring is thereby compressed by the lever 34 on one end 38A of the spring 38 and the keeper 39 on the other end of the spring 38 so as to force the lever 34 to engage the notch 31F. Selection of the notch 31 establishes the selected angle of tilt according to the requirement of the user.

The lever 34 is disengaged from the notch 30 by depressing the lever 34 on one end with force F or lifting the opposite end with force G so as to disengage the lever from the notches and permit the user to change the angle of tilt.

Advantages of the lever arrangement of the present invention compared to the popit arrangement of the prior art is that the present invention permits disengagement by pressing on the lever rather than pulling on a pin as required by the posit pin of the prior art. Thus the lever can fit tightly into the notch causing a tight lockup of the mechanism yet can be easily removed with leverage force not present on the standard straight pull popit pin. Also yet another advantage is that the lever can be operated from either side of the bench using the toe to depress one end of the lever or lifting the other end of the lever. Therefore there is no need for the user to bend over making the operation more convenient and faster than the prior art. An overall advantage is that, the lever arrangement does not encounter the sticking problem inherent in the popit type of catch.

Figure 4:
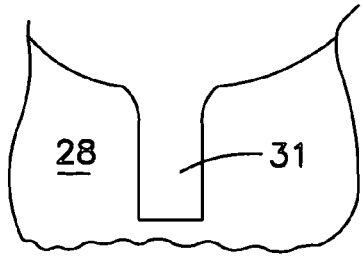
FIG. 4 shows details of the notches.

FIG. 4 shows another advantage of the notch construction wherein the notch can have inherently a deeper engagement than can be had with a hole in a plate which is limited by the thickness of the plate. Another advantage of the notch construction, which is an embodiment of the invention, is that the individual notches 31 have tapered sides so that the lever can "seek" alignment with the notch.

In yet another embodiment of the invention, as shown in FIG. 3, the keeper 39 over the spring and lever is provided with a set screw 41 through the housing abutting the lever. The set screw limits lateral movement of the lever which develops through use and ensures a tight lock of the arcuate curved bar 28 by engaging the flat surface of the bar as an adjustable stop.

The "tightness" (resistance to turn) of the lever 34 is adjustable by tightening or loosening the set screw 41 against the lever 34.

Figure 5B:
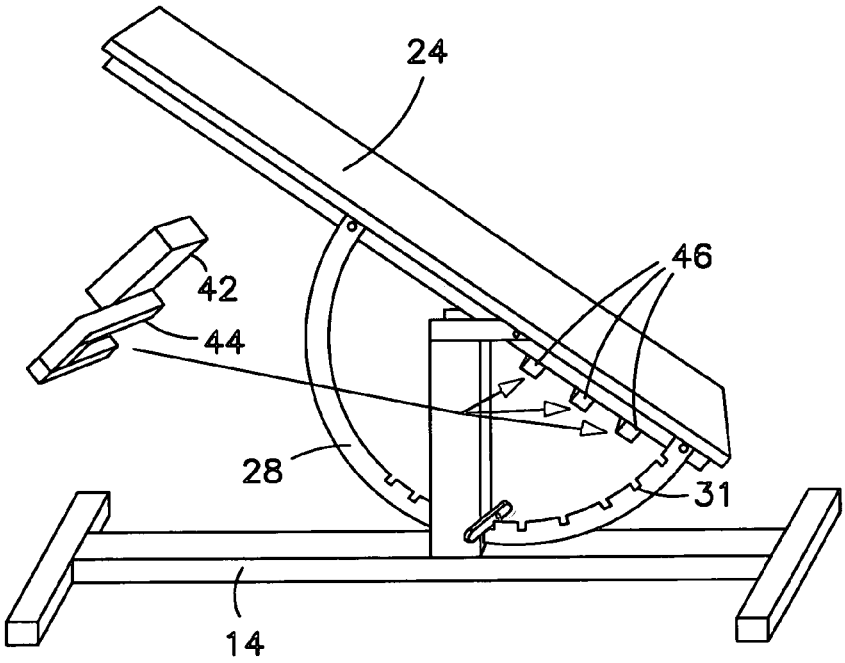
FIG. 5B is an exploded view showing a construction of a seat with a seat attachment bar that telescopes into one of an row of square tubes.
Figure 5A:
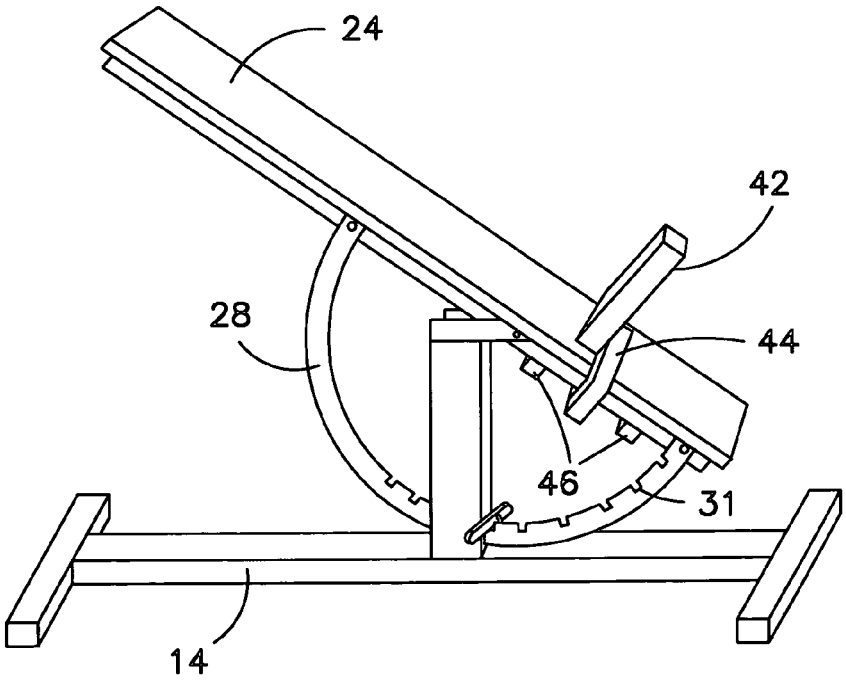
FIG. 5A is an assembly view.

FIG. 5A is an assembly view, and FIG. 5B is an exploded view showing a construction of a seat 42 with a seat attachment 44 that telescopes into one of a row of square tubes 46 attached to an underside of pad 24.

Figure 5D:
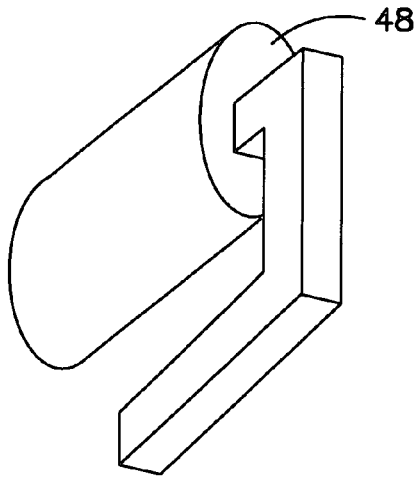
FIG. 5D shows a (padded) toe bar that can be very conveniently substituted for the seat.
Figure 5C:
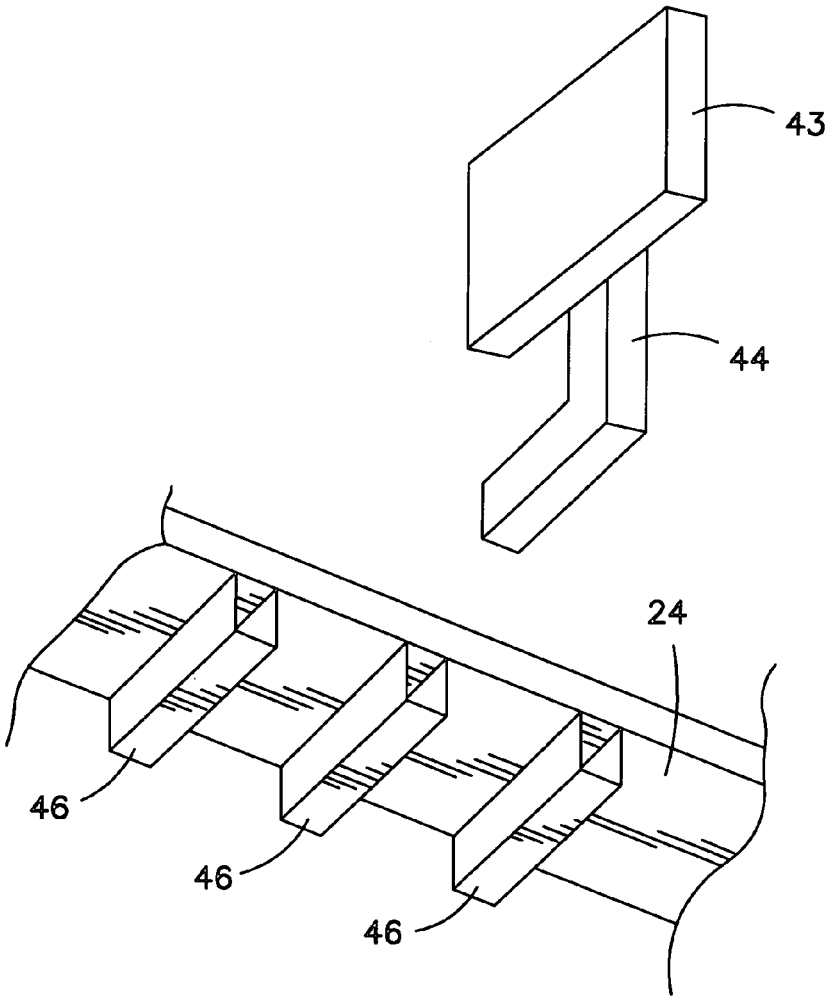
FIG. 5C shows a row of square tubes, mounted on the underside of the pad and the seat with seat attachment 44 poised for insertion into one of the tubes.

FIG. 5C shows to best, advantage, the row of square tubes 46, mounted on the underside of the pad 24 together with the seat 43 with seat attachment 44 poised for insertion into one of the tubes 46 This arrangement enables the user to independently select the distance of the seat from the end of the pad (back support) 24.

FIG. 5D shows a (padded) toe bar 48 that can be very conveniently substituted for the seat 43.

Situps are performed very conveniently by locating the padded toe bar 48 (in place of the seat) close to one end of the pad 24, lying on the pad 24, and hooking an ankle, toe or calf to the padded bar.

Alternatively, back extensions can be performed by locating the padded toe bar 48 in a tube close to the center of the pad 24, and hooking the heel or heels to the padded bar 48, and extending out over the far end of the pad.

Effectiveness of performing the back extensions and situps is enhanced by holding dumbbells while performing the back extensions and situps.

There has been described a construction for supporting a bench member at various selected angle of tilt that has substantial advantages over bench support members of the prior art. One advantage is that the construction avoids the experience encountered with popit pins used for similar purposes that considerable force is required to disengage the popit pin because the pins stick when slightly misaligned and when the components are built to tighter tolerance specifications. The leverage advantage of this invention allows a greater force to be applied to the locking lever.

Another advantage is that the user disengages the lever by pushing rather than by pulling and is thereby enable to exert greater force.

In yet another embodiment of the invention, the two parallel bars 22 affixed to one end of column 18 and providing the hinge point 22A extending out past the (cantilevered) side wall of column 18 allowing the bench pad support bar 24 to pivot to a position parallel to a column 18 while serving as a horizontal alignment stabilizer for bar 24 when rotated back to the horizontal position.

Variations and modifications of this invention may be contemplated after reading the specification and studying the drawings, which are within the scope of the invention.

In one variation, a bar attachable to the bench and securing the legs of the user are provided that secure the user's legs while he is performing situps.

I therefore wish to define the scope of my invention by the appended claims.

What is claimed is:

1. An exercise bench which comprises an H frame including a pair of parallel beams joined by a connecting beam and adapted to lie on a horizontal support surface;

a support post having one end secured to said connecting beam and extending vertically away from said H frame;

a bench member being a panel interfacing a pad, said pad having a top surface opposite said panel and said panel having a bottom surface opposite said pad;

a hinge member being a first hinge section mounted on said bottom surface and a second hinge section mounted on said base, and a hinge pin through said first and second sections and arranged to enable said bench member tiltable relative to a base;

said first section of said hinge member including a channel, comprising two parallel sides joined by a connecting side, said connecting side mounted on another end of said support post and extending parallel to said parallel beams;

said second section of said hinge member including a support bar secured flat against said bottom surface;

said channel and said support bar dimensioned and arranged to permit said support bar to nest between said parallel sides of said channel;

said hinge pin extending through said channel and said support bar;

a flat plate (28) having a broadest surface bounded by a major arcuate edge (28A) concentric with and larger than a minor arcuate edge (28B) and a pair of end edges (30A, B) between ends of the major and minor arcuate edges (28A,B);

said end edges of said plate secured to said bottom surface of said panel with said plate extending perpendicularly away from said bottom surface;

a row of tapered notches formed on said minor arcuate edge;

a lever means hingeably mounted on said base for engaging any one of said notches providing that an angle of tilt of said bench member relative to said base is selectable by a user;

said lever extending from one side of said bench member to an opposite side of said bench member operably arranged to provide accessibility to a user from a right side and a left side of said bench member;

a keeper means mounted on said support post and surrounding said lever for providing aligning support to said lever;

a spring means compressed between said keeper and said lever for biasing said lever toward said minor arcuate edge;

a set screw means threaded into said keeper and abutting said lever for providing adjustable frictional resistance to rotation of said lever.

2. The bench of claim 1 which further comprises:

a seat;

means for attaching said seat perpendicularly to said top surface of said bench member at any one of a plurality of selectable locations along said top surface enabling a user to sit on said seat with the user's back supported by said bench member.

3. The bench of claim 2 wherein said means for attaching at any one selectable locations comprises:

a plurality of tubes arranged side by side, each tube horizontally attached against said bottom surface of said bench member;

a bar member having one end attached to an underside of said seat;

said bar member arranged to permit telescoping an opposite end into any one of said tubes.

4. The bench of claim 1 which further comprises:

a toe bar;

means for attaching said toe bar at any one of a plurality of selectable locations adjacent a top surface of said bench member and arranged to permit a user to lie on said pad with one of a toe and heel hooked to said toe bar.

5. The bench of claim 4 wherein said means for attaching at any one selectable location comprises:

a plurality of tubes arranged side by side, each tube horizontally attached against a bottom surface of said bench member;

a bar member having one end attached to an underside of said seat and arranged to permit telescoping an opposite end of said bar member into any one of said tubes.

6. The bench of claim 1 which further comprises:

a seat;

a toe bar;

means for attaching said seat perpendicular and adjacent to a top side of said pad at any one of a plurality of selectable locations and said toe bar at any one of a plurality of selectable locations adjacent a topside of said pad;

said toe bar, when attached to said pad at one of said selectable locations, arranged to permit a user to lie on said pad with one of a toe and heel hooked to said toe bar;

said seat, when attached to said pad, arranged to permit a user to sit on said seat with the user's back supported by said pad.

7. The bench of claim 4 wherein said means for attaching at any one of a plurality of selectable locations comprises:

a plurality of tubes arranged side by side, each tube horizontally attached against an underside of said pad, said underside facing said base and perpendicular to a long dimension of said pad;

a first bar member having one end attached to an underside of said seat and arranged to permit telescoping an opposite end into any one of said tubes;

a second bar member having one end attached to one end of said toe bar and arranged to permit telescoping an opposite end into any one of said tubes.

8. An exercise bench which comprises a base;

a bench member being a panel interfacing a pad, said pad having a top surface opposite said panel and said panel having a bottom surface opposite said pad;

a hinge member being a first hinge section mounted on said bottom surface and a second hinge section mounted on said base, and a hinging pin through said first and second sections and arranged to enable said bench member tiltable relative to said base;

a flat plate (28) having a broadest surface bound by a major arcuate edge (28A) concentric with and larger than a minor arcuate edge (28B) and a pair of end edges (30A, B) between ends of the major and minor arcuate edges (28A,B);

said end edges of said plate secured to said bottom surface of said panel with said plate extending perpendicularly away from said bottom surface;

a row of notches formed on said minor arcuate edge;

a lever means hingeably mounted on said base ans arranged for engaging any one of said notches providing that an angle of tilt of said bench relative to said base and is selectable by a user.

9. The bench of claim 8 wherein said base comprises:

an H frame including a pair of parallel beams joined by a connecting beam and adapted to lie on a horizontal support surface;

a support post having one end secured to said connecting beam and extending vertically away from said H frame; and said first section of said hinge member including a channel, comprising two parallel sides joined by a connecting side, said connecting side mounted on another end of said support post and extending parallel to said parallel beams; and a second section of said hinge means including a support bar secured flat against said bottom surface;

said channel and said support bar dimensioned and arranged to permit said support bar to nest between said parallel sides of said channel; and said hinging pin extending through said channel and said support bar.

10. The bench of claim 9 further comprising a keeper member mounted on said support post and surrounding said lever for providing sliding support to said lever;

a spring member compressed between said keeper and said lever for biasing said lever toward said minor arcuate edge.

11. The bench of claim 10 comprising a set screw means threaded into said keeper and abutting said lever for providing adjustable frictional resistance to rotation of said lever.

12. The bench of claim 8 wherein each said notch is tapered whereby alignment of said lever with said selected notch is facilitated.

13. The bench of claim 8 wherein said lever extends from one side of said bench member to an opposite side of said bench member providing accessibility to a user from a right side and a left side of said bench member.

* * * * *